United States Patent [19]

Reiling et al.

[11] 4,270,315

[45] Jun. 2, 1981

[54] FIXTURE FOR HOLDING A TWIST DRILL TO BE REGROUND

[76] Inventors: Reinhold Reiling, Gründeltorstrasse 9; Karl Reiling, Pforzheimer Strasse 28, both of D-7531 Kämpfelbach-Ersingen, Fed. Rep. of Germany

[21] Appl. No.: 56,093

[22] Filed: Jul. 9, 1979

[30] Foreign Application Priority Data

Jul. 29, 1978 [DE] Fed. Rep. of Germany ..... 2833420
Apr. 18, 1979 [DE] Fed. Rep. of Germany ..... 2915601

[51] Int. Cl.[3] ..... B24B 3/26
[52] U.S. Cl. ..... 51/219 R
[58] Field of Search ..... 51/219 R, 219 PC, 125, 51/125.5

[56] References Cited

U.S. PATENT DOCUMENTS

| | | | |
|---|---|---|---|
| 622,212 | 4/1899 | Dutton | 51/219 R |
| 643,927 | 2/1900 | Walker | 51/219 R |
| 1,662,521 | 3/1928 | Kobis | 51/219 R |
| 2,556,073 | 6/1951 | Dixon | 51/219 R |
| 2,809,470 | 10/1957 | Nyholm | 51/219 R |
| 3,067,550 | 12/1962 | Schultz | 51/219 R |
| 3,952,459 | 4/1976 | Negley | 51/219 R |
| 4,142,332 | 3/1979 | Clarke | 51/125 |

*Primary Examiner*—Harold D. Whitehead
*Attorney, Agent, or Firm*—Balogh, Osann, Kramer, Dvorak, Genova & Traub

[57] ABSTRACT

A carriage is slidably mounted on a baseplate and longitudinally guided thereon in a predetermined direction. An angle bracket is slidably and pivotally mounted on and adapted to be fixed to said carriage and is guided thereon transversely to said predetermined direction. A crosspin is mounted on said angle bracket and adapted to extend transversely to said predetermined direction. A drill holder for holding a twist drill is fitted on said crosspin to be pivotally movable thereon and extends laterally of said angle bracket at an angle to said predetermined direction.

15 Claims, 6 Drawing Figures

FIXTURE FOR HOLDING A TWIST DRILL TO BE REGROUND

This invention relates to a fixture for holding a twist drill to be reground, particularly for use as an attachment for drilling machines or hobbyists' machinetools provided with a grinding wheel or grinding pad and preferably with a cutting-off wheel holder in accordance with U.S. Pat. No. 4,069,625 as a grinding wheel or grinding pad.

Special machines for a semi- or fully automatic regrinding of twist drills have been designed for industrial use but are too expensive for craftsmen and hobbyists. For the same purpose, simple fixtures have been disclosed, e.g., in Opened German Pat. No. 2,456,173 and 2,632,034 but can be handled only with special skill and cannot be used as an attachment to hobbyists' drilling machines but only in conjunction with a special grinding wheel stand.

It is an object of the invention to provide a fixture for holding a twist drill to be reground, particularly for use as an attachment for drilling machines and hobbyists' machines, which fixture permits a satisfactory regrinding of worn twist drills at an adjustable angle and can be used by hobbyists and craftsmen.

This object is accomplished according to the invention by a fixture having a baseplate, a carriage, which is longitudinally slidable on the baseplate, and an angle bracket, which is mounted on the carriage so as to be transversely slidable and pivotally movable and adapted to be fixed, a crosspin, which is mounted on the angle bracket and extends transversely to the main axis, and a drill holder, which extends at an angle to the main axis and is adapted to be pivotally fitted on the crosspin. A vertical retaining eye lug can be secured to one end of the horizontal baseplate and serves to receive a hand-held drilling machine so that its spindle axis extends in the direction of the main axis. The retaining eye lug preferably protrudes below the baseplate to serve as a bench stop. By means of such attachment, any commercially available drilling machine for hobbyists can be used for regrinding twist drills.

Because it is desired to use the fixture according to the invention also in conjunction with a grinding wheel stand, the retaining eye lug can be removed and a prismatic square is provided, which serves to position the baseplate with respect to the main axis of the grinding wheel stand. The baseplate is provided on all sides with transverse bores for receiving fixing fingers for the fixation to a bench.

According to a further concept of the invention, a still simpler and more reliable arrangement for regrinding twist drills for hobbyists can be provided. That fixture for holding a twist drill to be reground, particularly for use as an attachment for drilling machines and hobbyists' machines provided with a grinding wheel or grinding pad, comprises a pin that is transverse to the main axis or grinding axis and a drill holder, which is adapted to be fitted and pivotally mounted on said crosspin to extend at an angle thereto and comprises at one end a double prism for a selective fitting, which double prism has taper shank-holding means. The drill holder comprises at the other end continuous jaws for gripping the drill to be held. Such drill holder can be fitted in different positions so that the drill can be reground on all sides.

As has been explained hereinbefore, the baseplate may extend horizontally and in that case a vertical retaining eye lug can be attached, which serves for fixing a hand-held drilling machine so that its spindle axis extends in the direction of the main axis. The retaining eye lug preferably protrudes below the baseplate to serve as a bench stop. When provided with that fixture, any commercially available drilling machine for hobbyists can be used to regrind twist drills.

The drill holder which is adapted to be fitted and pivotally mounted and provided with double prism at one end is longitudinally split at the other end to form the two gripping jaws, which can be tightened by means of transverse guide pins and a tightening screw when the drill has been inserted.

Further details of the apparatus according to the invention are apparent from the accompanying drawings, which show two preferred embodiments.

Figure 1:
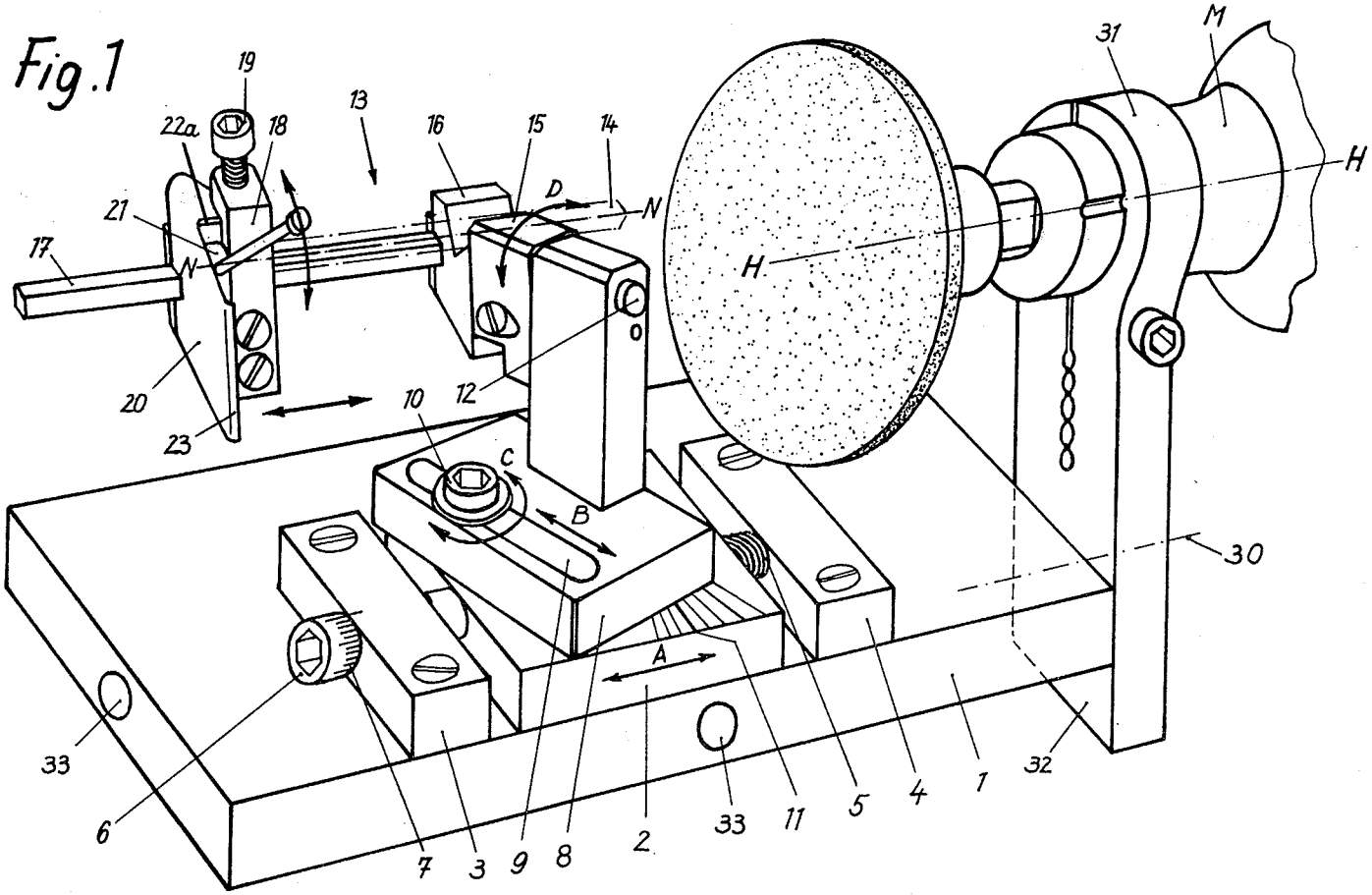
FIG. 1 is a perspective general view showing the apparatus in conjunction with a drilling machine for hobbyists, as the preferred use.
Figures 2, 3, 4:
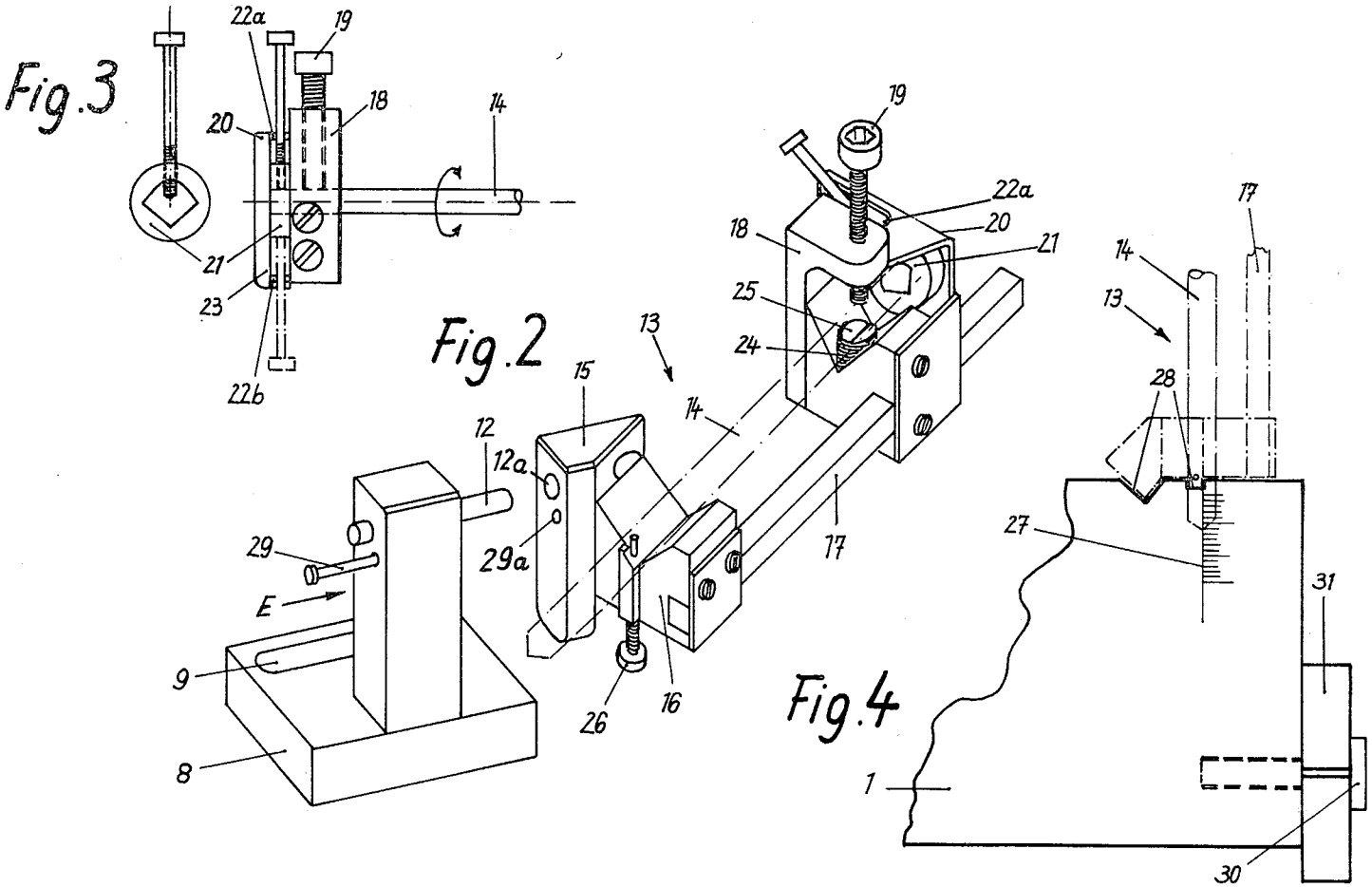
FIG. 2 is a perspective elevation showing the drill holder which has been removed and into which the twist drill has been inserted.
FIG. 3 is a front elevation with the rear taper shank holder and the heart-shaped turning member.
FIG. 4 is a fragmentary top plan view showing part of the baseplate with the contoured portion for mating engagement with the drill holder.

In FIGS. 1 to 4 of the drawings the fixture for holding the twist drill to be reground is shown in combination with a hobbyist's drilling machine M, as the preferred use. The fixture comprises a baseplate 1, on which a carriage 2 is longitudinally slidable in the direction A. The carriage 2 is adjustable between two stops 3, 4 by a screw 5. The head 6 of the screw 5 is provided with a scale 7, which permits of a uniform axial positioning of the drill in different rotational positions for regrinding.

An angle bracket 8 is mounted on the carriage 2 by means of a slot 9 and a pivot pin 10 so as to be transversely slidable on the carriage 2 in the direction B so that the entire grinding surface of the grinding wheel can be utilized, and to be pivotally movable in the direction C. The angle bracket is adapted to be fixed to the carriage 2, which is provided with a scale 11, from which the angular position of the angle member 8 can be read to facilitate the setting of the grinding angle at the point of the drill. The angle bracket 8 carries a crosspin 12. A drill holder 13 for holding a twist drill 14 to be reground in the direction D and having an axis N—N is adapted to be pivotally fitted to the crosspin 12 on the side thereof to extend at an angle to the main axis H—H.

The drill holder 13 comprises at one end a prism 15, which is adapted to be pivotally fitted on the crosspin 12 at 12*a*. The prism is provided with front and rear taper shank holders 16 and 18 for engaging the twist drill 14. The rear taper shank holder 18 is slidable on a guide rail 17 relative to the front taper shank holder 16 and is provided with a backing screw 19 and an end stop plate 20 for engaging the end of the twist drill 14 in its foremost position for being reground. A heart-shaped turning member 21 is freely rotatable through 180° between two stops 22*a* and 22*b* and is laterally received by the end stop plate 20 for the twist drill 14. The turning member 21 serves to turn the twist drill 14 between two positions for regrinding, e.g., when the twist drill has two helical flutes. To permit of a proper positioning even of thicker drills having a turned-off end shank, the rear taper shank holder 18 has also a fine-pitch screw 24 provided with a bearing cone 25. The screw 24 can be raised to a proper position at the center of the rear taper shank holder 18.

The front taper shank holder 16 is provided with a screw 26 for adjustably engaging the helical flute of the drill 14 to be fixed. The twist drill 14 to be reground must protrude from the front taper shank holder 16 in dependence on the diameter of the drill. The extent to which the drill protrudes is adjusted with reference to a longitudinal scale 27 on the baseplate 1. Adjacent to the scale 27, the baseplate 1 is provided with a contoured edge portion 28 for mating engagement with the front end face of the drill holder 14.

In the embodiment shown in FIGS. 1 to 4, the screw 26 for adjusting the cutting edge of the drill is laterally offset from the center of the taper shank holder 16 and one of the sloping side faces which are engageable with the twist drill 14 has a smaller inclination relative to the main plane of the baseplate 1 than the other of said side faces. In accordance with FIG. 2, the drill holder 13 consists of a separate unit, which can be removed for the fixation of the twist drill 14 and for cooling and inspecting the point of the drill 14 when the latter has been fixed.

During the regrinding of conventional twist drills 14, the drill holder 13 to which the drill 14 has been fixed is pivotally moved in the direction D so that a rounded surface is ground, which provides a clearance angle. When it is desired to regrind a flat bevelled surface on carbide-tipped twist drills, a plug pin 29 is inserted at 29*a* in the direction E parallel to the crosspin 12 so that the drill holder is locked against a pivotal movement and is movable only in the direction A during the grinding operation, which then results in a flat surface.

In the embodiment shown in FIGS. 1 to 4, the baseplate 1 is horizontal and a vertical retaining eye lug 31 is detachably secured to the end face of the baseplate 1 by means of a screw 30. The retaining eye lug 31 serves to hold a hand-held drilling machine M so that its spindle axis extends in the main direction H—H. The retaining eye lug 31 preferably protrudes below the baseplate 1 to serve as a bench s top 32.

When the fixture according to the invention is to be used together with a grinding wheel stand, the retaining eye lug 31 provided with a bench stop 32 is replaced by a prismatic square, not shown, for positioning the baseplate 1 with respect to the main axis H—H of the grinding wheel stand. For an additional fixation by fixing means known per se, the baseplate 1 is provided on all sides with transverse bores 33 for receiving such fixing means so that the fixture can be satisfactorily fixed.

Figures 5, 6:
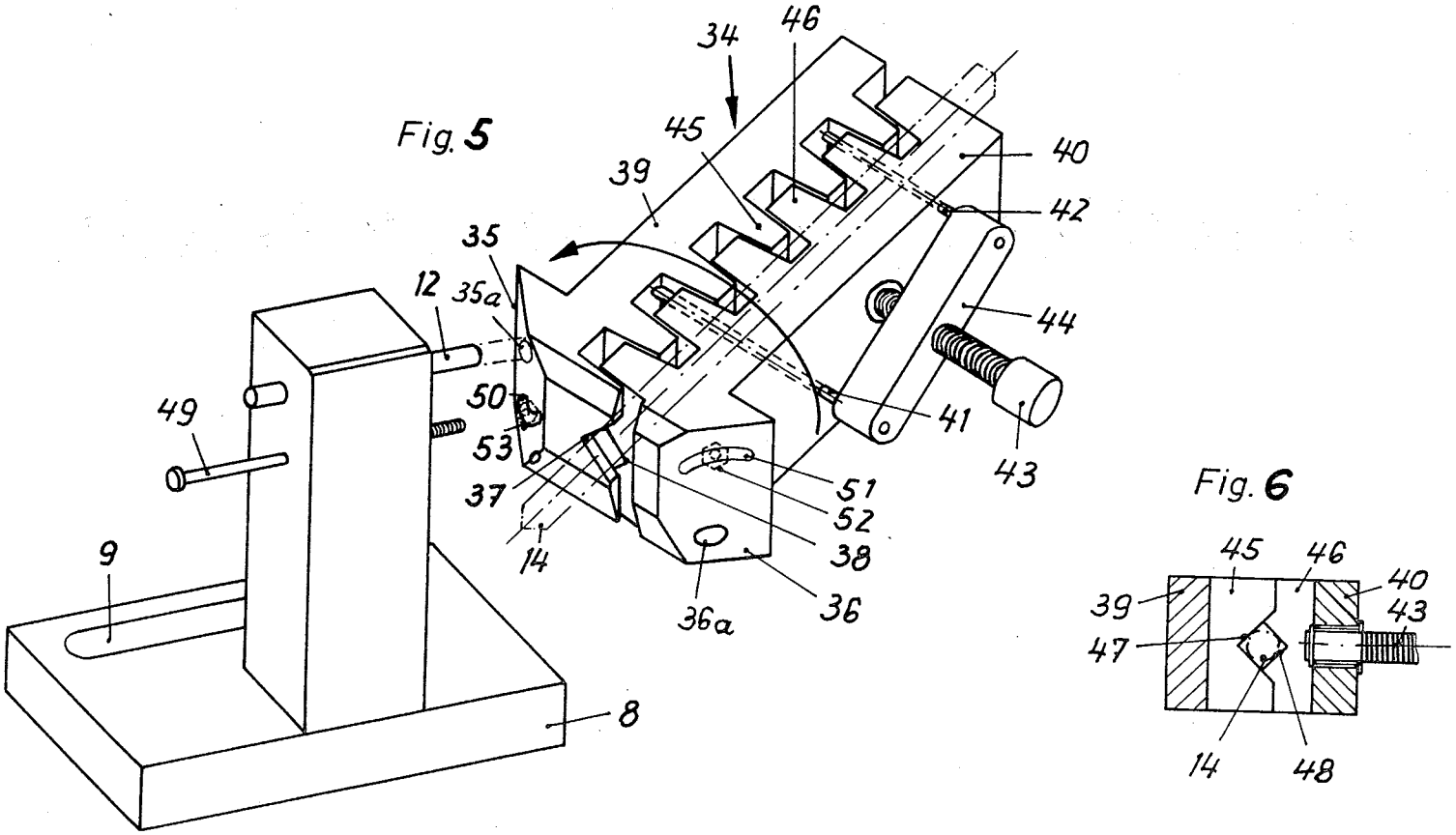
FIG. 5 is a perspective elevation showing the removed drill holder according to the further development, with the inserted twist drill.
FIG. 6 is a transverse sectional view showing the drill holder of FIG. 5.

In the embodiment shown in FIG. 5, the drill holder 13, 15 for the twist drill 14 shown in FIGS. 1 to 4 is replaced by a drill holder 34, which is provided at one end with a double prism 35, 36 which is adapted to be fitted on the crosspin 12 in alternative positions and has taper shank holders 37, 38. At the other end, the drill holder 34 has jaws 39, 40 for gripping the drill 14. The drill holder 34 which is adapted to be pivotally fitted and provided at one end with a double prism 35, 36 is longitudinally split at the other end to form the two gripping jaws 39, 40, which are adapted to be formed against the inserted drill 14 by means of transverse guide pins 41, 42 and a tightening screw 43 screwed through the lateral tightening bar 44. Th comblike gripping jaws 39, 40 have interfitting teeth 45, 46, which have mutually oppositely directed, conical recesses 47, 48 for receiving and gripping the drill 14.

Just as in the first embodiment, the drill holder 34 in which the drill 14 is fixed is pivotally moved in the direction corresponding to the direction D in FIG. 1 during the regrinding of conventional twist drills 14 so that a rounded surface providing for a clearance angle is ground. When the drill has been reground on one side with the bore 35*a* of the prism 35 fitted on the crosspin 12, the bore 36*a* of the prism 36 is then fitted on the crosspin 12 so that the drill has been turned through 180 and can then be reground on the other side. The drill is pivotally moved in the direction D as it is ground on either side. When the drill holder 34 is used for a regrinding of carbide-tipped drills to form a flat bevelled surface thereon, the plug screw 49 is inserted into one or the other of arcuate slots 50, 51 of the double prism 35, 36 and is screwed into one of the nuts 52, 54 so as to fix the drill holder in the angular position which is required for surface grinding. In that case the drill holder cannot be rotated and can only be moved in the direction A in FIG. 1 during the regrinding operation.

Just as in the first embodiment, a vertical retaining eye lug 31 is detachably secured by a screw 30 to the horizontal baseplate 1. That retaining eye lug 31 serves to hold a hand-held drilling machine M so that its spindle axis extends in the main direction H—H. The retaining eye lug 31 preferably protrudes below the baseplate 1 to serve as a bench stop 32. When the fixture is used with a grinding wheel stand, the retaining eye lug 31 provided with a bench stop 32 is replaced by a prismatic square, not shown, for positioning the baseplate 1 with respect to the main axis H—H of the wheel stand. For an additional fixation by fixing means known per se, the baseplate 1 is provided on all sides with transverse bores 33 for receiving such fixing means so that the fixture can be fixed satisfactorily in the manner shown in FIG. 1.

What is claimed is:

1. A fixture for holding a twist drill to be reground, comprising:

a baseplate, a carriage slidably mounted on said baseplate and longitudinally guided thereon in a predetermined direction, an angle bracket slidably and pivotally mounted on and adapted to be fixed to said carriage and guided thereon transversely to said predetermined direction, a crosspin mounted on said angle bracket and adapted to extend transversely to said predetermined direction, and a drill holder adapted to hold a twist drill, and detachably fitted on said crosspin to be pivotally movable thereon and extending laterally of said angle bracket at an angle to said predetermined direction, said drill holder being longitudinally split to form two jaws for gripping a twist drill, and including tightening means for forcing said jaws against said twist drill, said tightening means comprising a tightening bar which extends on the outside of one of said jaws and carries transverse guide pins slidably extending through said one jaw and secured to the other of said jaws, and said jaws being comblike and provided with interfitting teeth which have mutually oppositely-directed conical recesses for engaging said twist drill.

2. A fixture as set forth in claim 1, in which
said baseplate is horizontally disposed and
a vertical retaining eye lug is detachably secured to one end of said baseplate and is adapted to receive a hand-held drilling machine so that its spindle axis extends in said predetermined direction.

3. A fixture as set forth in claim 2, in which said retaining eye lug protrudes below and baseplate to serve as a bench stop.

4. A fixture as set forth in claim 1, in which
said baseplate is provided with two stops spaced apart in said predetermined direction,
said carriage is disposed between said stops, and
said baseplate carries a rotatably mounted screw, which is operable to move said carriage in said predetermined direction between said stops.

5. A fixture as set forth in claim 4, in which said screw has a head provided with a scale for indicating the position of said carriage.

6. A fixture as set forth in claim 1, in which
said carriage carries a pivot pin,
said angle bracket has a slot receiving said pivot pin, and
said carriage is provided with an angle scale for indicating the grinding angle at the point of a twist drill held by said drill holder.

7. A fixture as set forth in claim 1, which comprises positioning means for holding said drill holder in position for a regrinding of bevelled surfaces.

8. A fixture as set forth in claim 7, in which said positioning means comprise a hole formed in said drill holder and a plug pin fitted in said angle bracket and said hole and extending parallel to said crosspin.

9. A fixture as set forth in claim 1, in which said driller holder is mounted on said crosspin so as to be detachable therefrom with said twist drill held by said drill holder.

10. A fixture as set forth in claim 9, in which
said drill holder has a contoured front end face and is adapted to hold said twist drill in a position in which said twist drill protrudes from said front end face,
said baseplate has a contoured side face portion for mating engagement with said front end face when said drill holder has been removed from said crosspin, and
said baseplate is provided adjacent to said contoured side face portion with a scale for measuring the extent by which said twist drill protrudes from said front end face.

11. A fixture as set forth in claim 1, in which said baseplate is provided on all sides with transverse bores for receiving fixing fingers.

12. A fixture as set forth in claim 1, for holding a twist drill to be reground by means of a grinding wheel stand having a main axis, comprising a prismatic square for positioning said baseplate with respect to said main axis.

13. A fixture as set forth in claim 1, in which
said drill holder comprises at one end said gripping jaws, and
at the other end a double prism adapted to be fitted on said crosspin in alternative positions, and provided with taper shank-holding means for engaging said twist drill.

14. A fixture as set forth in claim 13, in which
said double prism has two bores adapted to be fitted on said crosspin in alternative positions of said drill holder and also has two arcuate slots, each of which is concentric to one of said bores, and
a screw extends through said angle bracket and one of said slots and is fixed to said double prism by a nut threaded on said screw, to hold said drill holder in an adjusted angular position with respect to said crosspin so as to rotate only in a predetermined direction.

15. A fixture as set forth in claim 13, in which
said drill holder further comprises
a tightening screw is threaded through said tightening bar, and bears on said one jaw and is rotatable to force said one jaw against a twist drill disposed between said jaws.

* * * * *